US005888644A

United States Patent [19]

Yoshida et al.

[11] Patent Number: 5,888,644

[45] Date of Patent: Mar. 30, 1999

[54] THERMAL TRANSFER RECORDING MATERIAL

[75] Inventors: Katsuhiro Yoshida; Kotaro Akashiro, both of Osaka, Japan

[73] Assignee: Fujicopian Co., Ltd., Osaka, Japan

[21] Appl. No.: 683,610

[22] Filed: Jul. 15, 1996

[30] Foreign Application Priority Data

Jul. 17, 1995 [JP] Japan ..... 7-180138

[51] Int. Cl.[6] ..... B41M 5/26

[52] U.S. Cl. ..... 428/323; 428/195; 428/413; 428/484; 428/488.1; 428/500; 428/522; 428/913; 428/914

[58] Field of Search ..... 428/195, 484, 428/488.1, 323, 413, 522, 913, 207, 500, 914

[56] References Cited

U.S. PATENT DOCUMENTS 4,783,360 11/1988 Katayama et al. ..... 428/484

*Primary Examiner*—Pamela R. Schwartz
*Attorney, Agent, or Firm*—Fish & Neave

[57] ABSTRACT

A thermal transfer recording material is provided which comprises a foundation and, provided thereon, a heat-meltable ink layer comprising a coloring agent, a heat-meltable binder material and a particulate wax, the heat-meltable binder material comprising 30 to 90% by weight of an epoxy resin and 10 to 70% by weight of a copolymer resin comprising vinyl chloride and vinyl acetate, the particulate wax having an average particle diameter of 0.05 to 15 μm.

6 Claims, 1 Drawing Sheet

THERMAL TRANSFER RECORDING MATERIAL

BACKGROUND OF THE INVENTION

The present invention relates to thermal transfer recording materials for providing printed images having excellent fastness on diverse receptors.

Conventional thermal transfer recording materials, in general, include those comprising a foundation and, applied onto the foundation, a heat-meltable ink containing a vehicle composed mainly of a wax or another type of heat-meltable ink containing a vehicle composed mainly of a resin for ensuring printed images of good quality even on paper sheets having relatively poor surface smoothness or printed images of high scratch resistance.

Recently, bar code printers and label printers using thermal transfer recording materials have been used to print bar codes or like codes for management of parts or products in production processes of manufacturing factories, merchandise management in the distribution field, management of articles at using sites, and the like. When used in, for example, the distribution field, bar codes are frequently scratched or rubbed. Therefore, such bar codes are required to have particularly high scratch resistance.

As well as for the printing of bar codes, thermal transfer printers have been used in the production of diversified products in small quantities, including outdoor advertising materials, election posters, common posters, standing signboards, stickers, catalogs, pamphlets, calenders and the like in the commercial printing field; bags for light packaging, labels of containers for foods, drinks, medicines, paints and the like, and binding tapes in the packaging field; and labels for indicating quality characteristics, labels for process control, labels for product management and the like in the apparel field. These articles are also required to exhibit scratch resistance.

With respect to the receptors on which bar codes are formed by the thermal transfer method, specialized receptors such as polyethylene terephthalate film subjected to a special surface treatment were used. Recently, plastic films subjected to no surface treatment such as typical polyethylene terephthalate film and vinyl chloride resin film have also been used, which leads to diversification of receptors. More recently, cutting plotters begin to spread and printed films wherein printed images are formed on vinyl chloride resin films by the thermal transfer method are frequently used therefor.

With the conventional thermal transfer recording materials using the heat-meltable ink containing a vehicle composed mainly of a wax, however, resulting printed images exhibit poor scratch resistance though the ink enjoys satisfactory transferability (separability of the ink layer). On the other hand, with the conventional thermal transfer recording materials using the heat-meltable ink containing a vehicle composed mainly of a resin such as ethylene-vinyl acetate copolymer, the transferability of the ink is inferior to the former ink due to its relatively high melt viscosity though resulting printed images enjoy relatively high scratch resistance. Moreover, both of the thermal transfer recording materials provide printed images having poor adhesion to common plastic films, especially vinyl chloride resin films, resulting in poor scratch resistance.

It is, therefore, an object of the present invention to provide a thermal transfer recording material which is capable of exhibiting satisfactory transferability (separability of the ink layer) while at the same time forming printed images having excellent adhesion to diverse plastic films and excellent scratch resistance.

The foregoing and other objects of the present invention will be apparent from the following detailed description.

SUMMARY OF THE INVENTION

According to the present invention, there is provided a thermal transfer recording material comprising a foundation and, provided thereon, a heat-meltable ink layer comprising a coloring agent, a heat-meltable binder material and a particulate wax, the heat-meltable binder material comprising 30 to 90% by weight of an epoxy resin and 10 to 70% by weight of a copolymer resin comprising vinyl chloride and vinyl acetate, the particulate wax having an average particle diameter of 0.05 to 15 $\mu$m.

In an embodiment of the present invention, the epoxy resin comprises at least one member selected from the group consisting of tetraphenolethane tetraglycidyl ether, cresol novolac polyglycidyl ether, bisphenol A diglycidyl ether and bisphenol F diglycidyl ether.

In another embodiment of the present invention, the copolymer resin has a vinyl chloride content of 50 to 95% by weight, a number average molecular weight of 2,000 to 110,000 and a glass transition point of 40° to 80° C.

In still another embodiment of the present invention, the particulate wax has a melting point of 60° to 130° C.

In a further embodiment of the present invention, the particulate wax comprises at least one wax selected from the group consisting of a polyethylene wax, an oxidized polyethylene wax, a polypropylene wax, an oxidized polypropylene wax, Fischer-Tropsch wax and carnauba wax.

In still a further embodiment of the present invention, the amount of the particulate wax is from 5 to 50% by weight based on the total amount of the heat-meltable binder material and the particulate wax.

DETAILED DESCRIPTION

Figure 1:
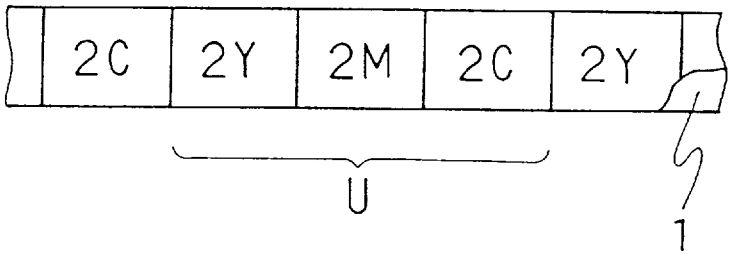
FIG. 1 is a partial plan view showing an example of an arrangement of color ink layers of respective colors in an embodiment of the thermal transfer recording material of the present invention.

The present invention will now be described in detail.

In the present invention, the heat-meltable ink layer comprises a coloring agent, a heat-meltable binder material and a particulate wax, the heat-meltable binder material comprising 30 to 90% by weight, preferably 50 to 70% by weight of an epoxy resin and 10 to 70% by weight, preferably 30 to 50% by weight of a copolymer resin comprising vinyl chloride and vinyl acetate, the particulate wax having an average particle diameter of 0.05 to 15 $\mu$m.

The combination use of an epoxy resin and a copolymer resin comprising vinyl chloride and vinyl acetate in the specific ratio as the heat-meltable binder material improves the adhesion of the ink to a variety of plastic films, especially vinyl chloride resin film, as well as the transferability (separability) of the ink layer as compared with the conventional resin-type ink layer, resulting in printed images having excellent scratch resistance and like properties. Herein, the term "separability of a heat-meltable ink layer" means the property that, when being transferred, the heated portion of a heat-meltable ink layer is easily separated from the unheated portion of the heat-meltable ink layer and only the heated portion is transferred onto a receptor to give a sharp print image.

That is, the epoxy resin mainly contributes to the improvement of separability of the ink layer, leading to excellent transferability. The copolymer resin comprising vinyl chloride and vinyl acetate mainly contributes to the improvement of adhesion of the ink to vinyl chloride resin films due to the presence of the vinyl chloride component, leading to excellent scratch resistance, and to the improvement of adhesion of the ink to various plastic films other than vinyl chloride resin film due to the presence of the vinyl acetate component.

When the proportion of the epoxy resin is smaller than the above range or the proportion of the copolymer resin comprising vinyl chloride and vinyl acetate is larger than the above range, the transferability of the ink layer is not satisfactorily improved because the amount of the epoxy resin contributing to an improvement in separability of the ink layer is small and the adhesion of the ink to the foundation is excessively strong. When the proportion of the epoxy resin is larger than the above range or the proportion of the copolymer resin comprising vinyl chloride and vinyl acetate is smaller than the above range, the adhesion of the ink to various plastic films, especially vinyl chloride resin film is not satisfactorily improved, resulting in poor scratch resistance.

Further, a particulate wax having an average particle diameter of 0.05 to 15 $\mu$m, preferably 0.1 to 10 $\mu$m, is dispersed in the heat-meltable binder material, which provides further improved separability when being transferred. Moreover, since particles of the wax appear on the surface of printed images, the printed images enjoy further improved scratch resistance.

If the average particle diameter of the particulate wax is smaller than the above range, wax particles are submerged in the ink layer and hence appear less on the surface of printed images, resulting in unsatisfactorily enhanced scratch resistance. If it is greater than the above range, the ink layer suffers poor separability, resulting in degraded transferability all the more.

To ensure improved scratch resistance, the particulate wax preferably has an average particle diameter 1 to 1.5 times as large as the thickness of the ink layer. Herein, the thickness of the ink layer means an average thickness of those portions of the ink layer in which any wax particles are absent.

The epoxy resin used in the present invention is not limited to a particular one, and any usual epoxy resins can be used. From the viewpoints of dispersibility of a coloring agent and transferability of the resulting ink, however, the epoxy resin preferably comprises not less than 50% (% by weight, hereinafter the same), more preferably not less than 70% of at least one epoxy resin selected from the group consisting of tetraphenolethane tetraglycidyl ether, cresol novolac polyglycidyl ether, bisphenol A diglycidyl ether and bisphenol F diglycidyl ether.

In the present invention it is particularly desirable that the epoxy resin be entirely composed of at least one of the above-specified epoxy resins. It is, however, not necessarily required to do so, and the epoxy resin comprising not less than 50%, preferably not less than 70% of at least one of the four specified epoxy resins can serve the purpose. If the proportion of such specified epoxy resin in the overall epoxy resin is less than the foregoing range, poor dispersibility of a pigment in the heat-meltable binder material will result, thus deteriorating the transferability of the ink layer.

Tetraphenolethane tetraglycidyl ether (hereinafter referred to as "TPETGE" as the need arises) as aforementioned, having a softening point of 92° C., is a species of polyfunctional epoxy resins and represented by the formula (I):

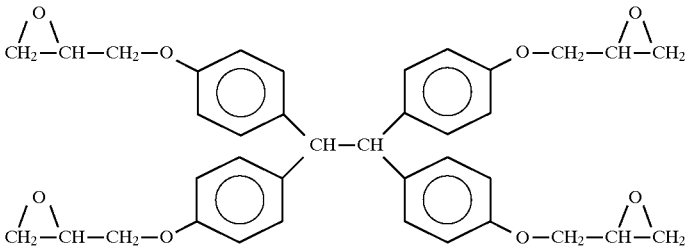

(I)

Cresol novolac polyglycidyl ether (hereinafter referred to as "CNPGE" as the need arises) as aforementioned is a species of polyfunctional epoxy resins. In the present invention examples of preferred cresol novolac polygylcidyl ethers include those represented by the formula (II):

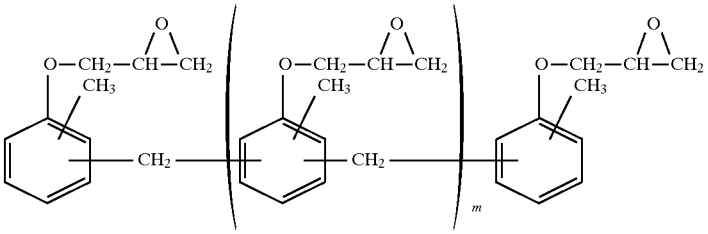

(II)

wherein m is usually an integer of from 3 to 7. CNPGEs useful in the present invention include mixtures of those of the formula (II) wherein values for m are different from each other. CNPGE preferably has a softening point of 60° to 120° C.

Bisphenol A diglycidyl ether (hereinafter referred to as "BPADGE" as the need arises) is a species of difunctional epoxy resins. Preferred are those represented by the formula (III):

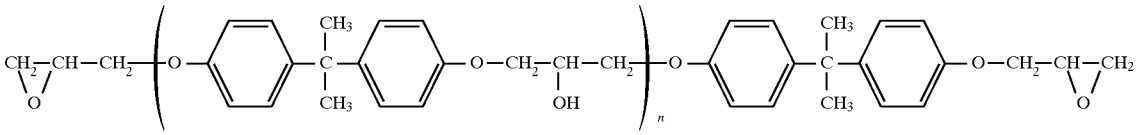

(III)

wherein n is usually an integer of from 0 to 13. BPADGEs useful in the present invention include mixtures of those of the formula (III) wherein values for n are different from each other. BPADGE preferably has a softening point of 60° to 140° C.

Bisphenol F diglycidyl ether (hereinafter referred to as "BPFDGE" as the need arises) is a species of difunctional epoxy resins. Preferred are those represented by the formula (IV):

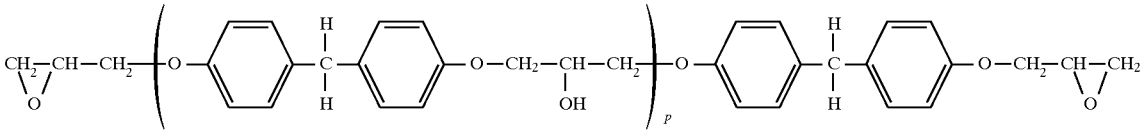

(IV)

wherein p is usually an integer of from 0 to 33. BPFDGEs useful in the present invention include mixtures of those of the formula (IV) wherein values for p are different from each other. BPFDGE preferably has a softening point of 60° to 140° C.

Examples of epoxy resins that can be used in combination with the aforementioned specified epoxy resins are:

(1) Glycidyl ether type epoxy resins including, for example, brominated bisphenol A diglycidyl ether, brominated bisphenol F diglycidyl ether, hydrogenated bisphenol A diglycidyl ether, glycerol triglycidyl ether, pentaerythritol diglycidyl ether and naphthol-modified cresol novolac polyglycidyl ether;

(2) Glycidyl ether ester type epoxy resins including, for example, p-oxybenzoic acid glycidyl ether ester;

(3) Glycidyl ester type epoxy resins including, for example, phthalic acid diglycidyl ester, tetrahydrophthalic acid diglycidyl ester, hexahydrophthalic acid diglycidyl ester and dimer acid diglycidyl ester;

(4) Glycidyl amine type epoxy resins including, for example, glycidylaniline, triglycidyl isocyanurate and tetraglycidylaminodiphenylmethane;

(5) Linear aliphatic epoxy type epoxy resins including, for example, epoxidized polybutadiene and epoxidized soybean oil; and (6) Alicyclic epoxy type epoxy resins including, for example, 3,4-epoxy-6-methylcyclohexylmethyl 3,4-epoxy-6-methylcyclohexanecarboxylate and 3,4-epoxycyclohexylmethyl 3,4-epoxycyclohexanecarboxylate.

These epoxy resins may be used either alone or as mixtures of two or more species thereof. Preferable as epoxy resins usable in combination with the specified epoxy resins are those having softening points of not lower than 60° C. However, an epoxy resin in a liquid state can also be used so long as the overall heat-meltable binder material resulting from mixing it with the specified epoxy resin or the epoxy resin usable in combination therewith or the copolymer resin comprising vinyl chloride and vinyl acetate has a softening point of not lower than 60° C.

Preferable as the copolymer resin comprising vinyl chloride and vinyl acetate are typical vinyl chloride-vinyl acetate copolymer resins. More preferable are vinyl chloride-vinyl acetate copolymer resins having a vinyl chloride content of 50 to 95%, more preferably 60 to 90%, a number average molecular weight of 2,000 to 110,000, more preferably 3,000 to 70,000 and a glass transition point of 40° to 80° C. When the content of the vinyl chloride component is lower than the above range, the resulting ink is prone to provide poor adhesion to vinyl chloride resin films. When the content of the vinyl chloride component is higher than the above range, the resulting ink is prone to provide poor transferability. When the number average molecular weight is smaller than the above range, the resulting ink is prone to provide printed images having unsatisfactory scratch resistance. When the number average molecular weight is larger than the above range, the resulting ink is prone to provide poor transferability.

The heat-meltable binder material according to the present invention may be incorporated with one or more heat-meltable resins other than the above-mentioned so long as the purpose of the present invention is attained. Examples of such heat-meltable resins include ethylene-vinyl acetate copolymer resin, ethylene-alkyl (meth)acrylate copolymer resin, phenolic resin, copolymer resin of styrene and acrylic monomer, polyester resin and polyamide resin. Such heat-meltable resins are used in an amount of preferably not greater than 15%, more preferably not greater than 5% based on the amount of the overall heat-meltable binder material.

The softening point of the overall heat-meltable binder material is preferably within the range of from 60° to 120° C. in terms of the storage stability and transferability of the thermal transfer recording material.

The proportion of the overall heat-meltable binder material in the heat-meltable ink layer is preferably from about 50 to about 95% in terms of the transferability and like properties of the ink layer.

Examples of specific particulate waxes for use in the present invention are those formed from, either alone or in combination, vegetable waxes such as carnauba wax, candelilla wax and rice wax; animal waxes such as bees wax and lanolin; mineral waxes such as montan wax and ceresin wax; petroleum waxes such as paraffin wax and microcrystalline wax; and synthetic hydrocarbon waxes such as Fischer-Tropsch wax, polyethylene wax, oxidized polyethylene wax, polypropylene wax and oxidized polypropylene wax These particulate waxes may be used either alone or in combination of two or more species. Particularly preferable among the above particulate waxes are those formed from polyethylene wax, oxidized polyethylene wax, polypropylene wax, oxidized polypropylene wax, Fischer-Tropsch wax and carnauba wax in terms of good slip properties of their particle surfaces.

The particulate wax preferably has a melting point of from 60° to 130° C., more preferably from 80° to 110° C. If the melting point of the wax is lower than the above range, the resulting printed images obtain unsatisfactorily improved scratch resistance because the wax is completely melted upon thermal transfer and, therefore, wax particles will not appear on the surface of the printed images and the slip property of the wax particle surfaces cannot be expected. On the other hand, if the melting point is higher than the above range, the ink layer tends to have degraded transferability because the wax is hardly melted upon thermal transfer and, hence, will not contribute to the transferability of the ink layer.

The amount of the particulate wax to be blended is preferably within the range of 5 to 50% based on the total amount of the vehicle (which means the total of the heat-meltable binder material and the particulate wax) used in the heat-meltable ink layer. If the amount of the particulate wax is less than the above range or greater than the above range, resulting printed images often exhibit insufficiently improved scratch resistance.

The proportion of the vehicle in the heat-meltable ink is preferably from about 40 to about 95% in terms of the transferability and like properties of the ink layer.

Useful as the coloring agent in the present invention are various organic and inorganic pigments, inclusive of carbon black. Examples of such organic and inorganic pigments include azo pigments (such as insoluble azo pigments, azo lake pigments and condensed azo pigments), phthalocyanine pigments, nitro pigments, nitroso pigments, anthraquinonoid pigments, nigrosine pigments, quinacridone pigments, perylene pigments, isoindolinone pigments, dioxazine pigments, titanium white, calcium carbonate and barium sulfate. Such pigments may be used in combination with dyes. The proportion of the coloring agent in the ink layer is suitably within the range of from 5 to 60%.

Yellow pigments, magenta pigments, and cyan pigments, and optionally black pigments are used for forming multi-color or full-color printed images utilizing subtractive color mixture.

The pigments for yellow, magenta and cyan for use in the ink layer are preferably transparent, while the pigments for black are usually opaque.

Examples of transparent yellow pigments include organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake. These pigments may be used either alone or in combination of two or more species thereof.

Examples of transparent magenta pigments include organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y, Arizalin Lake and Quinacridone Red. These pigments may be used either alone or in combination of two or more species thereof.

Examples of transparent cyan pigments include organic pigments such as Victoria Blue Lake, metal-free Phthalocyanine Blue, Phthalocyanine Blue and Fast Sky Blue. These pigments may be used either alone or in combination of two or more species thereof.

The term "transparent pigment" means a pigment which gives a transparent ink when dispersed in a transparent vehicle.

Examples of black pigments include inorganic pigments having insulating or conductive properties such as carbon black, and organic pigments such as Aniline Black. These pigments may be used either alone or in combination of two or more species thereof.

The proportion of the coloring agent in respective color ink layer is usually from about 5 to about 60%.

In the present invention the heat-meltable ink layer may be incorporated with appropriate additives such as a dispersing agent as well as the aforementioned ingredients.

The heat-meltable ink layer can be formed by applying onto a foundation a coating liquid prepared by dissolving or dispersing the epoxy resin, the vinyl chloride-vinyl acetate copolymer resin and the particulate wax in a solvent which is capable of dissolving the resins but incapable of dissolving the particulate wax, or by dispersing the epoxy resin, the vinyl chloride-vinyl acetate copolymer resin and the particulate wax in a solvent (inclusive of water) which is capable of dissolving neither the resins nor the particulate wax and then dissolving or dispersing the coloring agent together with other additives, followed by drying at such a temperature range as not to ruin the particle form of the particulate wax.

The coating amount (on a solid basis, hereinafter the same) of the heat-meltable ink layer in the present invention is usually 0.02 to 5 $g/m^2$, preferably 0.5 to 3 $g/m^2$.

The foundation for the thermal transfer recording material of the present invention may consist of, polyester films such as polyethylene terephthalate film, polybutylene terephthalate film, polyethylene naphthalate film, polybutylene naphthalate film and polyarylate film, polycarbonate film, polyamide film, aramid film, polyether sulfone film, polysulfone film, polyphenylene sulfide film, polyether ether ketone film, polyether imide film, modified polyphenylene ether film and polyacetal film, and other various plastic films commonly used for the foundation of ink ribbons of this type. Alternatively, thin paper sheets of high density such as condenser paper can also be used. The thickness of the foundation is usually from about 1 to about 10 $\mu$m. From the standpoint of reducing heat spreading to increase the resolution of printed images, the thickness of the foundation is preferably from 1 to 6 $\mu$m.

Where the thermal transfer recording material of the present invention is to be used in a thermal transfer printer with a thermal head, a conventionally known stick-preventive layer is preferably provided on the back side (the side to be brought into slide contact with the thermal head) of the foundation. Examples of materials for the stick-preventive layer include various heat-resistant resins such as silicone resins, fluorine-containing resins and nitrocellulose resins, and other resins modified with these heat-resistant resins such as silicone-modified urethane resins and silicone-modified acrylic resins, and mixtures of the foregoing heat-resistant resins and lubricating agents.

The term "thermal transfer recording material" as used herein includes a thermal transfer recording material for forming monochromatic images, and a thermal transfer recording material for forming multi-color or full-color images utilizing subtractive color mixture.

The thermal transfer recording material for forming monochromatic images is of a structure in which a monochromatic heat-meltable ink layer is provided on a foundation. Colors for the monochromatic heat-meltable ink layer include black, red, blue, green, yellow, magenta and cyan.

An embodiment of the thermal transfer recording material for forming multi-color or full-color images is of a structure in which on a single foundation are disposed a yellow heat-meltable ink layer, a magenta heat-meltable ink layer and a cyan heat-meltable ink layer and, optionally, a black heat-meltable ink layer in a side-by-side relation. Such color ink layers can be disposed in various manners on a foundation depending on the kind of printer.

FIG. 1 is a partial plan view showing an example of the thermal transfer recording material according to the foregoing embodiment. As shown in FIG. 1, on a single foundation 1 are disposed a yellow heat-meltable ink layer 2Y, a magenta heat-meltable ink layer 2M and a cyan heat-meltable ink layer 2C in a side-by-side relation These ink layers 2Y, 2M and 2C, each having a predetermined constant size, are periodically disposed longitudinally of the foundation 1 in recurring units U each comprising ink layers 2Y, 2M and 2C arranged in a predetermined order. The order of arrangement of these color ink layers in each recurring unit U can be suitably determined according to the order of transfer of the color ink layers. Each recurring unit U may comprise a black ink layer in addition to the layers 2Y, 2M and 2C.

Another embodiment of the thermal transfer recording material for forming multi-color or full-color images is a set of thermal transfer recording materials comprising a first thermal transfer recording material having a yellow heat-meltable ink layer on a foundation, a second thermal transfer recording material having a magenta heat-meltable ink layer on another foundation, and a third thermal transfer recording material having a cyan heat-meltable ink layer on yet another foundation, and, optionally a fourth thermal transfer recording material having a black heat-meltable ink layer on still another foundation.

The use of any of the foregoing embodiments of the thermal transfer recording materials will give multi-color or full-color images having excellent scratch resistance. Further, individual color heat-meltable ink layers in the present invention are excellent in superimposing properties, thus ensuring multi-color or full-color images of superior color reproducibility.

To form printed images using the thermal transfer recording material of the present invention the ink layer is superimposed on an image-receiving body and heat energy is applied imagewise to the ink layer. A thermal head is typically used as a heat source of the heat energy. Alternatively, any conventional heat sources can be used such as laser light, infrared flash and heat pen.

Where the image-receiving body is not a sheet-like material but a three-dimensional article, or one having a curved surface, thermal transfer using laser light is advantageous since application of heat energy is easy.

The formation of multi-color or full-color images with use of the thermal transfer recording material of the present invention is performed, for example, as follows. Using a thermal transfer printer with one or plural thermal heads the yellow ink layer, the magenta ink layer and the cyan ink layer are selectively melt-transferred onto a receptor in a predetermined order in response to separation color signals of an original multi-color or full-color image, i.e., yellow signals, magenta signals and cyan signals to form yellow ink dots, magenta ink dots and cyan ink dots on the receptor in a predetermined order, thus yielding a yellow separation image, a magenta separation image and a cyan separation image superimposed on one another on the receptor. The order of transfer of the yellow ink layer, magenta ink layer and cyan ink layer can be determined as desired. When a usual multi-color or full-color image is formed, all the three color ink layers are selectively transferred in response to the corresponding three color signals to form three color separation images on the receptor. When there are only two color signals, the corresponding two of the three color ink layers are selectively transferred to form two color separation images.

Thus there is obtained a multi-color or full-color image comprising: (A) at least one region wherein a color is developed by subtractive color mixture of at least two superimposed inks of yellow, magenta and cyan, or (B) a combination of the region (A) and at least one region of a single color selected from yellow, magenta and cyan where different color inks are not superimposed. Herein a region where yellow ink dots and magenta ink dots are present in a superimposed state develops a red color; a region where yellow ink dots and cyan ink dots are present in a superimposed state develops a green color; a region where magenta ink dots and cyan ink dots are present in a superimposed state develops a blue color; and a region where yellow ink dots, magenta ink dots and cyan ink dots are present in a superimposed state develops a black color. A region where only yellow, magenta or cyan ink dots are present develops a yellow, magenta or cyan color.

In the above manner a black color is developed by the superimposing of yellow ink dots, magenta ink dots and cyan ink dots. A black color may otherwise be obtained by using only black ink dots instead of three color ink dots. Further alternatively, a black color may be obtained by superimposing black ink dots on at least one of yellow, magenta and cyan ink dots, or on superimposed ink dots of at least two of yellow, magenta and cyan ink dots.

In forming printed images using the thermal transfer recording material, the printed images may be directly formed on a final object, or alternatively by previously forming the printed images on a sheet-like image-receiving body (receptor) and then bonding the image-receiving body thus bearing the printed images to a final object with suitable means such as an adhesive.

Useful as the receptor are a variety of plastic films (this term is intended to include sheets, hereinafter the same) including typical polyethylene terephthalate film and vinyl chloride resin films such as polyvinyl chloride film. Of course, receptors subjected to a surface treatment for thermal transfer can be used.

The present invention will be more fully described by way of Examples and Comparative Examples. It is to be understood that the present invention is not limited to these Examples, and various changes and modifications may be made in the invention without departing from the spirit and scope thereof.

EXAMPLES 1–9 AND COMPARATIVE EXAMPLES 1–3

A 5 $\mu$m-thick polyethylene terephthalate film was formed on one side thereof with a stick-preventive layer composed of a silicone resin with a coating amount of 0.25 g/m$^2$. Onto the opposite side of the polyethylene terephthalate film with respect to the stick-preventive layer was applied an ink coating liquid of the formula shown in Table 1, followed by drying to form a heat-meltable ink layer with a coating amount of 2 g/m$^2$, yielding a thermal transfer recording material.

It should be noted that the average particle diameter of wax particles in a wax dispersion or a wax powder was measured using a laser diffraction particle size distribution measuring apparatus (SALD-1100 available from SHIMADZU CORPORATION).

TABLE 1

| | Ex. 1 | Ex. 2 | Ex. 3 | Ex. 4 | Ex. 5 | Ex. 6 | Ex. 7 | Ex. 8 | Ex. 9 | Com. Ex. 1 | Com. Ex. 2 | Com. Ex. 3 |
|---|---|---|---|---|---|---|---|---|---|---|---|---|
| Formula of ink coating liquid (%) | | | | | | | | | | | | |
| Araldite ECN1280*1 | 11 | — | — | — | — | — | — | — | — | — | — | — |
| EOCN-7000*2 | — | 7 | — | — | — | — | — | — | — | — | — | — |
| Epikote 1031S*3 | — | — | 6 | — | — | 5 | 6 | 6 | 6 | — | — | — |
| Epikote 4007P*4 | — | — | — | 2.5 | — | — | — | — | — | — | — | — |
| Epikote 1003*5 | — | — | — | — | 6 | — | — | — | — | 14 | 4 | 10 |
| PVCA-I*6 | 1.5 | — | 6 | — | — | 5 | 6 | 6 | 6 | — | — | — |
| PVCA-II*7 | — | 3.5 | — | — | — | — | — | — | — | — | — | — |
| PVCA-III*8 | — | — | — | 4.5 | 6 | — | — | — | — | — | 10 | 2 |
| Vylon 200*9 | — | — | — | — | — | 2 | — | — | — | — | — | — |
| X-7204*10 | 15 | — | 20 | — | — | 20 | 20 | 20 | 20 | — | — | — |
| X-7148*11 | — | 35 | — | — | — | — | — | — | — | — | — | — |
| FTP-1005*12 | — | — | — | 7 | — | — | — | — | — | — | — | — |
| POLYMIST B-6*13 | — | — | — | — | 2 | — | — | — | — | — | — | — |
| A-C7*14 | — | — | — | — | — | — | — | — | — | — | — | 2 |
| Carbon black | 6 | 6 | 6 | 6 | 6 | 6 | — | — | — | 6 | 6 | 6 |
| Yellow pigment*15 | — | — | — | — | — | — | 6 | — | — | — | — | — |
| Magenta pigment*16 | — | — | — | — | — | — | — | 6 | — | — | — | — |
| Cyan pigment*17 | — | — | — | — | — | — | — | — | 6 | — | — | — |
| Methyl ethyl ketone | 66.5 | 48.5 | 62 | 80 | 80 | 62 | 62 | 62 | 62 | 80 | 80 | 80 |

*1CNPGE made by Asahi-CIBA Limited, softening point: 80° C.
*2Naphthol-modified cresol novolac polyglycidyl ether made by Nippon Kayaku Co., Ltd., softening point: 90° C.
*3TPETGE made by Yuka Shell Epoxy Kabushiki Kaisha, softening point: 92° C.
*4BPFDGE made by Yuka Shell Epoxy Kabushiki Kaisha, softening point: 109° C.
*5BPADGE made by Yuka Shell Epoxy Kabushiki Kaisha, softening point: 89° C.
*6Vinyl chloride-vinyl acetate copolymer resin, vinyl chloride content: 86%, number averge molecular weight: 20,000, glass transition point: 72° C.
*7Vinyl chloride-vinyl acetate copolymer resin, vinyl chloride content: 86%, number averge molecular weight: 14,000, glass transition point: 72° C.
*8Vinyl chloride-vinyl acetate copolymer resin, vinyl chloride content: 60%, number averge molecular weight: 49,700, glass transition point: 53° C.
*9Polyester resin made by Toyobo Co., Ltd., softening point; 163° C.
*10Oxidized polyethylene wax dispersion (10% solid content) made by GIFU SHELLAC MFG. CO., LTD., melting point: 102° C., average particle diameter: 3 μm
*11Polyethylene wax dispersion (10% solid content) made by GIFU SHELLAC MFG. CO., LTD., melting point: 102° C., average particle diameter: 3 μm
*12Fischer-Tropsch wax powder made by Nippon Seiro Co., Ltd., melting point: 106° C., average particle diameter: 4 μm
*13Polyethylene wax powder made by Allied Signal Inc., melting point: 126° C., average particle diameter: 6 μm
*14Polyethylene wax powder made by Allied Signal Inc., melting point: 107° C., average particle diameter: 20 μm
*15Sanyo Color Works, Ltd., C.I. Pig. No. Y-12
*16Sanyo Color Works, Ltd., C.I. Pig. No. R-122
*17Sanyo Color Works, Ltd., C.I. Pig. No. B-15-2

Using each of the thermal transfer recording materials thus obtained, printing was performed to print bar code patterns on the receptor mentioned below with a thermal transfer type bar code printer (B-30 made by TEC Corp.) under the following conditions:

Printing conditions

Applied energy: 22.6 mJ/mm$^2$

Printing speed: 2 inches/second

Platen pressure: "High" in terms of an indication prescribed in the printer

Receptor

A: 70 μm-thick soft polyvinyl chloride film (subjected to no surface treatment) (hereinafter referred to as "PVC film")

B: 100 μm-thick polyethylene terephthalate film (subjected to no surface treatment) (hereinafter referred to as "PET film")

The resulting printed images were evaluated for their transferability and scratch resistance (crocking resistance and smear resistance).

The results are shown in Table 2.

Transferability

Using a bar code reader (Codascan II produced by RJS ENTERPRISES, INC), the printed images were subjected to a reading test according to the following judgment criteria:

○: completely readable;

Δ: partially readable; and

×: impossible to read.

Scratch resistance (crocking resistance)

The printed images were rubbed under the following conditions and then subjected to the reading test as above.

Tester: A.A.T.C.C. Crock Meter Model CM-1 produced by

ATLAS ELECTRIC DEVICE COMPANY

Rubbing material: Cotton cloth

Pressure: 500 g/cm$^2$

Number of reciprocations: 300

Scratch resistance (smear resistance)

The printed images were rubbed under the following conditions and then subjected to the reading test as above.

Tester: Rub Tester produced by Yasuda Seiki Seisakusho Ltd.

Rubbing material: Corrugated fiberboard

Pressure: 250 g/cm$^2$

Number of reciprocations: 300

TABLE 2

| | PVC film | | | PET film |
|---|---|---|---|---|
| | Transfer-ability | Crocking Resistance | Smear resistance | Transfer-ability |
| Ex. 1 | ○ | ○ | ○ | ○ |
| Ex. 2 | ○ | ○ | ○ | ○ |
| Ex. 3 | ○ | ○ | ○ | ○ |
| Ex. 4 | ○ | ○ | ○ | ○ |
| Ex. 5 | ○ | ○ | ○ | ○ |
| Ex. 6 | ○ | ○ | ○ | ○ |
| Ex. 7 | ○ | ○ | ○ | ○ |
| Ex. 8 | ○ | ○ | ○ | ○ |
| Ex. 9 | ○ | ○ | ○ | ○ |
| Com. Ex. 1 | Δ | Δ | ○ | Δ |
| Com. Ex. 2 | X | X | X | X |
| Com. Ex. 3 | X | X | X | X |

As seen from the foregoing, the thermal transfer recording material of the present invention offers excellent transferability (separability of the ink layer) and provides printed images exhibiting good adhesion to diverse plastic films and high scratch resistance and hence is highly useful in printed images such as bar codes.

In addition to the materials and ingredients used in the Examples, other materials and ingredients can be used in the present invention as set forth in the specification to obtain substantially the same results.

What we claim is:

1. A thermal transfer recording material comprising a foundation and, provided thereon, a heat-meltable ink layer comprising a coloring agent, a heat-meltable binder material and a particulate wax, the heat-meltable binder material comprising 30 to 90% by weight of an epoxy resin and 10 to 70% by weight of a copolymer resin comprising vinyl chloride and vinyl acetate, the particulate wax having an average particle diameter of 0.05 to 15 $\mu$m.

2. The thermal transfer recording material of claim 1, wherein the epoxy resin comprises at least one member selected from the group consisting of tetraphenolethane tetraglycidyl ether, cresol novolac polyglycidyl ether, bisphenol A diglycidyl ether and bisphenol F diglycidyl ether.

3. The thermal transfer recording material of claim 1, wherein the copolymer resin has a vinyl chloride content of 50 to 95% by weight, a number average molecular weight of 2,000 to 110,000 and a glass transition point of 40° to 80° C.

4. The thermal transfer recording material of claim 1, wherein the particulate wax has a melting point of 60° to 130° C.

5. The thermal transfer recording material of claim 1, wherein the particulate wax comprises at least one wax selected from the group consisting of a polyethylene wax, an oxidized polyethylene wax, a polypropylene wax, an oxidized polypropylene wax, Fischer-Tropsch wax and carnauba wax.

6. The thermal transfer recording material of claim 1, wherein the amount of the particulate wax is from 5 to 50% by weight based on the total amount of the heat-meltable binder material and the particulate wax.

* * * * *